US006874242B2

(12) United States Patent
Shilo et al.

(10) Patent No.: US 6,874,242 B2
(45) Date of Patent: Apr. 5, 2005

(54) DUAL SPACING WIDTH TILE SPACER

(76) Inventors: Erez Shilo, 223 Franklin Pl., Woodmere, NY (US) 11598; Yitshak Shilo, 223 Franklin Pl., Woodmere, NY (US) 11598

( * ) Notice: Subject to any disclaimer, the term of this patent is extended or adjusted under 35 U.S.C. 154(b) by 0 days.

(21) Appl. No.: 10/256,903

(22) Filed: Sep. 27, 2002

(65) Prior Publication Data

US 2004/0060184 A1 Apr. 1, 2004

(51) Int. Cl.[7] ..... G01D 21/00
(52) U.S. Cl. ..... 33/526; 33/645; 33/DIG. 20
(58) Field of Search ..... 33/526, 527, 613, 33/645, DIG. 20, 562

(56) References Cited

U.S. PATENT DOCUMENTS

| | | | | | |
|---|---|---|---|---|---|
| 2,031,684 | A | * | 2/1936 | Berger | 52/396.1 |
| 2,797,495 | A | * | 7/1957 | Walston | 33/518 |
| 2,930,135 | A | * | 3/1960 | Rodtz, Sr. | 33/526 |
| 3,010,213 | A | * | 11/1961 | Rodtz, Sr. | 33/526 |
| 3,735,497 | A | * | 5/1973 | Boettcher | 33/526 |
| 4,793,068 | A | * | 12/1988 | Golkar | 33/526 |
| 4,953,341 | A | * | 9/1990 | Joos | 33/DIG. 20 |
| 4,955,142 | A | * | 9/1990 | Rieck | 33/526 |
| 5,201,130 | A | * | 4/1993 | Krchnak | 33/526 |
| 5,288,534 | A | * | 2/1994 | Tavshanjian | 33/526 |
| 5,623,799 | A | * | 4/1997 | Kowalski et al. | 52/392 |
| 2002/0121027 | A1 | * | 9/2002 | Kruskamp | 33/526 |

FOREIGN PATENT DOCUMENTS

| | | | |
|---|---|---|---|
| DE | 29623364 U1 | * | 4/1998 |
| EP | 258108 A | * | 3/1988 |
| GB | 2331322 A | * | 5/1999 |
| GB | 2334731 A | * | 9/1999 |

* cited by examiner

*Primary Examiner*—Christopher W. Fulton
*Assistant Examiner*—Madeline Gonzalez
(74) *Attorney, Agent, or Firm*—Howard C. Miskin, Esq.; Gloria Tsui-Yip, Esq.

(57) ABSTRACT

A reusable dual spacing width tile spacer for aligning, spacing and pressing tiles. The tile spacer includes a planar horizontal body having two, three or four outer vertical legs around the body. The body has a generally center opening for visual access to the intersecting corners of the tiles and for ease of removal of the tile spacer. The legs are aligned with each other to form a straight line, T-shape or cross-shape. Each leg has top and bottom portions, each portion having a different predetermined width for different tile spacing widths.

24 Claims, 4 Drawing Sheets

DUAL SPACING WIDTH TILE SPACER

FIELD OF THE INVENTION

The invention relates to a device for mounting tiles. In particular, a device for aligning, spacing and pressing tiles that is reusable, easy to handle, has dual spacing width and provide visual access to the intersecting tile corners.

BACKGROUND OF THE INVENTION

Ceramic or stone tiles, or sheets of mosaic tiles glued to a mesh webbing, are commonly used to cover floors, walls and counters. Each tile or sheet is individually set, spaced apart from other tiles, on an adhesive material. The spacing between tiles or sheets is then filled with grout. It is important that the spacing between tiles is uniform to provide a properly spaced and aligned tile pattern.

A spacer is normally utilized to achieve uniform spacing between tiles. A plurality of spacers is used when tiles are being laid onto adhesive material. A typical prior art spacer is shown in U.S. Pat. No. 2,031,684 issued on Feb. 25, 1936 to F. H. Berger, which discloses a cross shape spacer for defining the four corners of four intersecting tiles. The typical prior art spacer has a depth from ⅛ to 3⁄16 of an inch, which is less than the normal minimum thickness of tiles, ¼ of an inch, and spacing widths of between 1⁄16 to ⅜ of an inch. Prior art spacers of predetermined widths are generally laid onto the adhesive material with four intersecting tiles pushed up against the four corners of the cross shape spacer to achieve uniform spacing of the width of the spacers. Prior to filling the spacing with grout, prior art spacers are removed with a pick or other tools because it sits below the surface of the adjacent tiles and on adhesive material, which is difficult and time consuming. Oftentimes, such prior art spacers are not retrieved and reused in view of the time and effort involved.

The small prior art cross-shape spacer is difficult to handle by the worker and U.S. Pat. No. 5,288,534 issued on Feb. 22, 1994 to B. A. Tavshanjian attempts to redress this problem. The '534 patent discloses a prior art, cross shape tile spacer having a platform wherein cross shapes extend from opposite surfaces of the platform, providing means for handling and removing the tile spacer and for pressing it when laying tiles. Although the tile spacer of the '534 patent is reusable and improves handling, it provides only a predetermined spacing width. Additionally, the platform prevents any visual access to the four intersecting corners of the files to determine proper alignment against the cross shape spacer.

Therefore, there is a need for a reusable tile spacer that is easy to handle, has multiple, or at least, dual spacing width and provide visual access to the intersecting tile corners.

SUMMARY OF THE INVENTION

The present invention provides a tile spacer that aligns, spaces and presses tiles that is reusable, easy to handle, has dual spacing width and provide visual access to the intersecting tile corners.

The tile spacer of the present invention comprises a planar horizontal body having two, three or four outer vertical legs around the body. The body has an opening. The legs are aligned with each other to form a straight line, T-shape or cross-shape. Each leg having top and bottom portions, each portion having a different predetermined width for different tile spacing widths.

When tiles are being laid onto adhesive materials, a tile spacer of the present invention is used for each set of four tiles at the four intersecting corners. Depending on the preferred spacing required, either the top or bottom portions of the legs are selected and set between the four corner edges of the tiles. The body provides a planar surface for pressing the corners of the tiles onto the adhesive material for proper alignment. The opening of the body provides visual confirmation that the tiles are properly aligned with respect to the four legs. When the tiles are properly laid onto the adhesive material, the tile spacer of the present invention may be easily removed by placing a finger into the opening and lift the tile spacer from the surface of the tiles.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
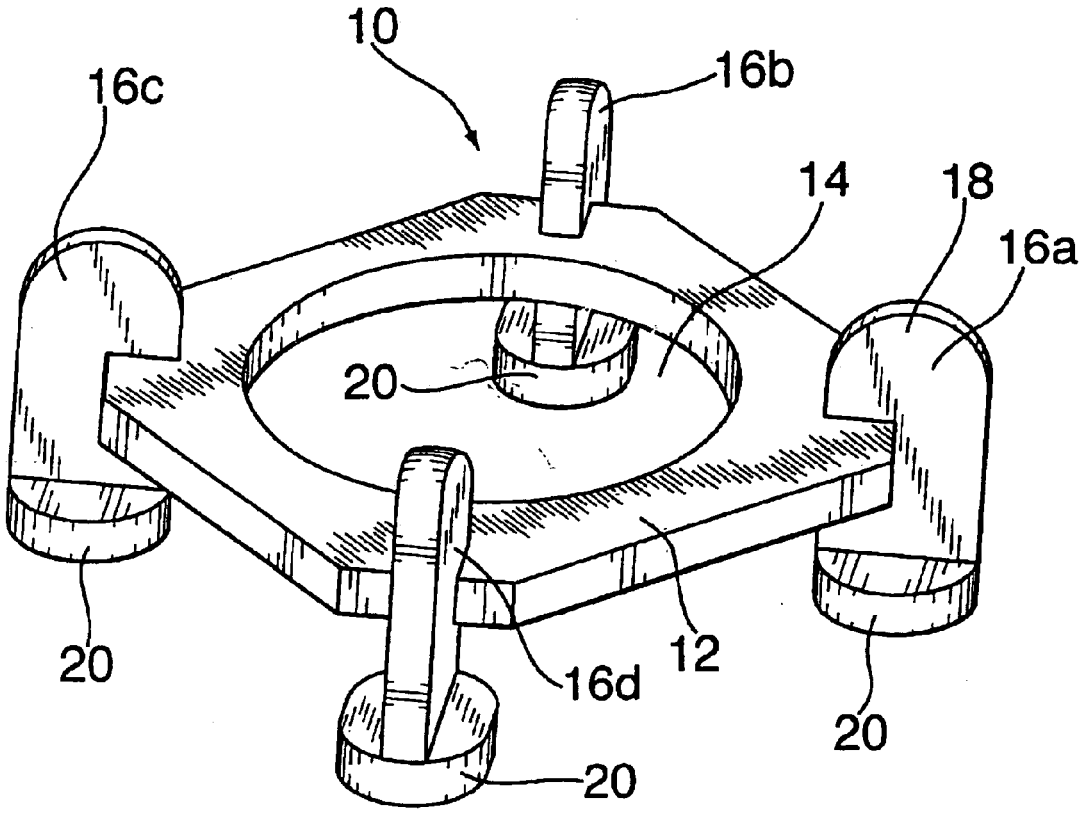
FIG. 1 is a perspective view of the tile spacer of the present invention.

With reference to the drawings, wherein the same reference number indicates the same element throughout, there is shown in FIG. 1 a tile spacer 10 of the present invention.

Figure 2:
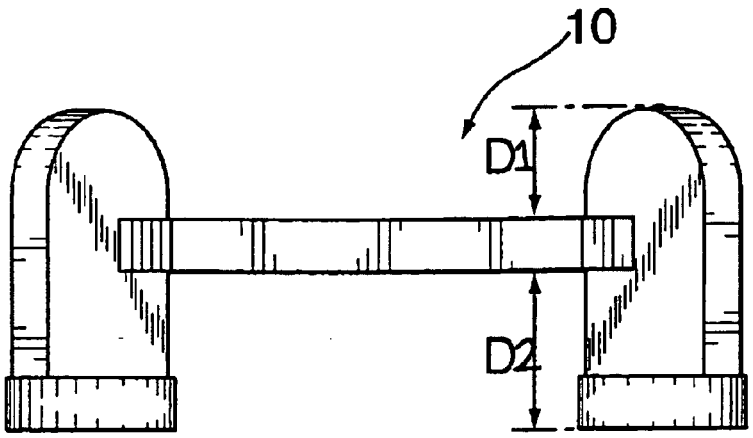
FIG. 2 is a side view of the tile spacer of the present invention.
Figure 3:
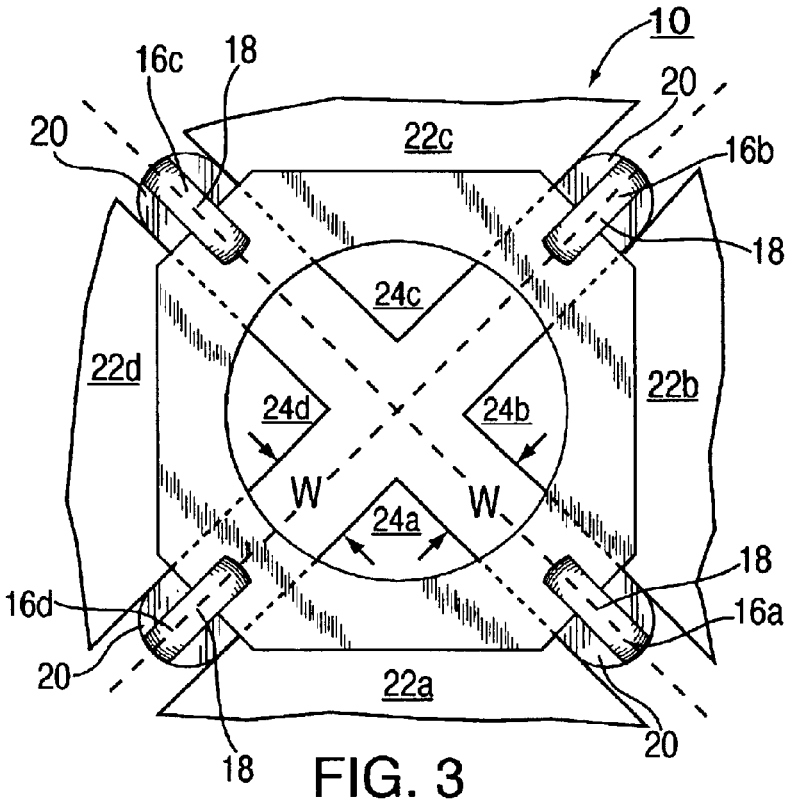
FIG. 3 illustrates the use of the bottom portions of the legs of the tile spacer for spacing four (4) tiles.
Figure 4:
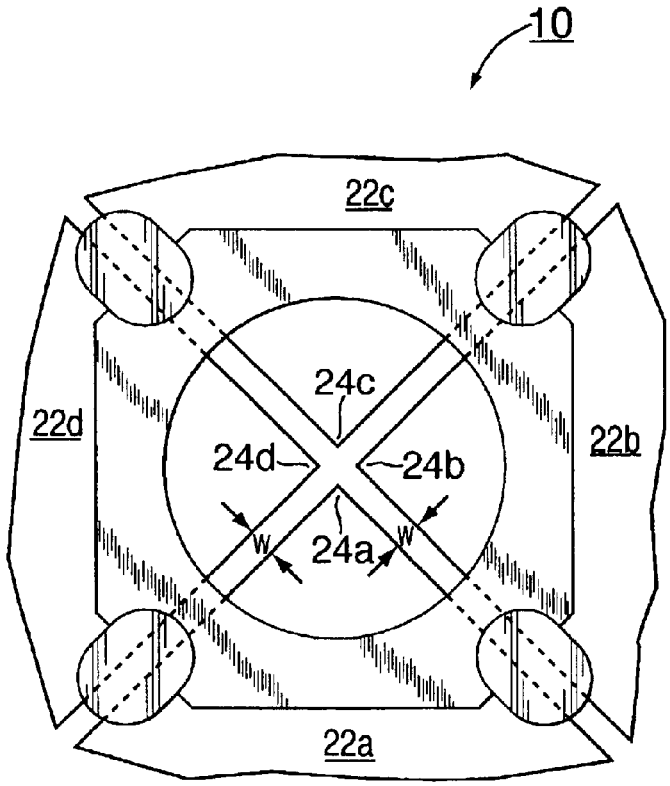
FIG. 4 illustrates the use of the top portions of the legs of the tile spacer for spacing for four (4) tiles.

The tile spacer 10 comprises a planar body 12 having four outer legs 16*a*–16*d* around the body 12. The planar body 12 has a center opening 14. The four legs 16*a*–16*d* are aligned with each other to form a cross (as shown in FIGS. 3 and 4). Each leg 16*a*–16*d* has a top portion 18 and a bottom portion 20 of different widths for different tile spacing widths. For example, the width, w, of the top portion 18 may be ⅛ of an inch and the width, W, of the bottom portion 20 may be ⅜ of an inch. Each leg extends from a surface of the body to a distance, D1 and D2 for the top portion 18 and bottom portion 20, respectively, preferably less than the thickness of the tiles being laid (see FIG. 2). Tiles are generally more than ¼ of an inch thick.

FIG. 3 illustrates the use of the tile spacer 10 to align, space and press four adjacent tiles 22*a*–22*d* using the bottom portions 20 of each leg 16*a*–16*d*. The intersecting corners 24*a*–24*d* of tiles 22*a*–22*d* are pushed up against the bottom portions 20 of each leg 16 for alignment and appropriate spacing width of W. Opening 14 provides visual access to the intersecting corners 24*a*–24*d* to confirm proper alignment and spacing width. Body 12 of the tile spacer 10 is then pressed against the surface of the tiles 22*a*–22*d* to set the tiles onto adhesive material. Thereafter, the tile spacer 10 is removed by placing a finger into the opening 14 to lift the tile spacer 10 before grout is used to fill the space between tiles 22*a*–22*d*.

FIG. 4 is similar to FIG. 3, except that the top portions 18 of each leg 16 are used to align tiles 22*a*–22*d* with a spacing width of w.

Figure 5:
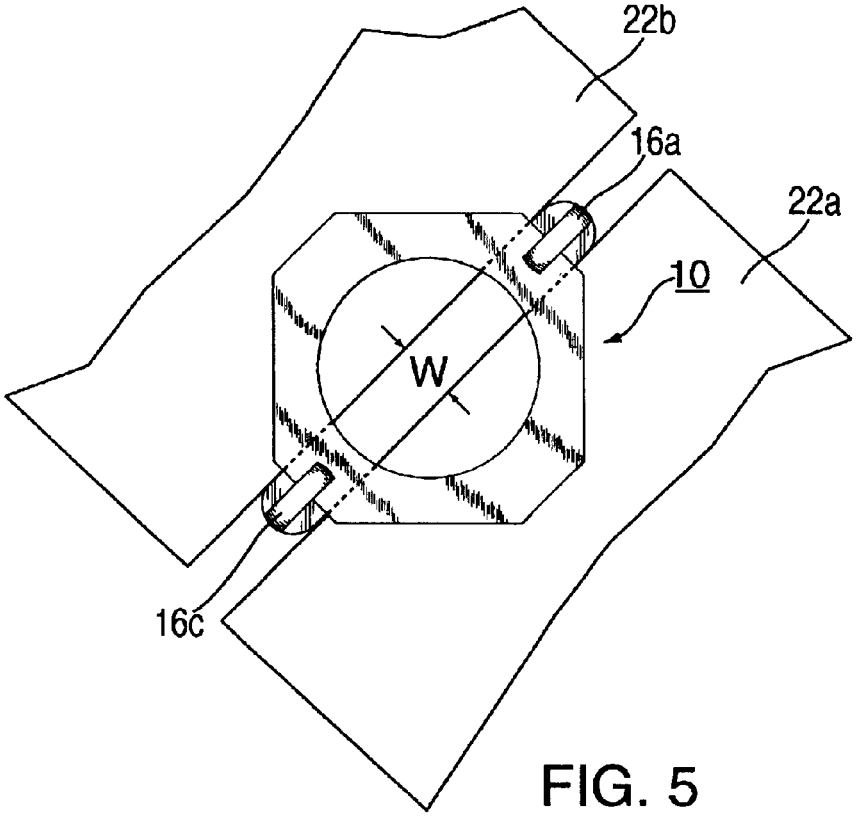
FIG. 5 is a "straight" tile spacer of the present invention separating two (2) adjoining tiles.
Figure 6:
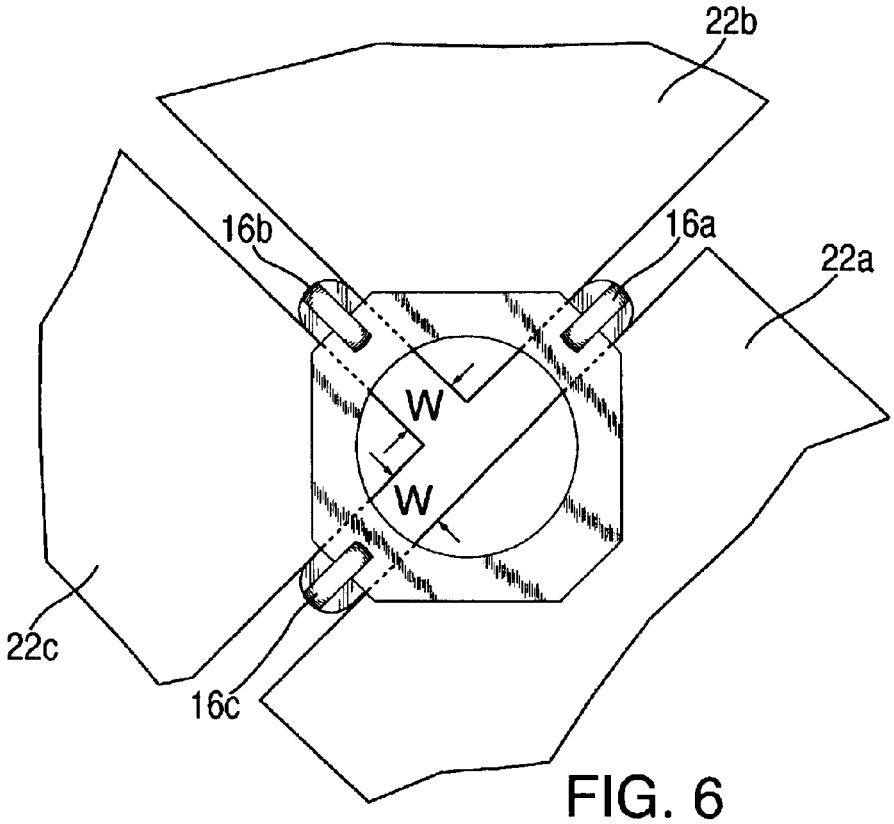
FIG. 6 is a T-shape tile spacer of the present invention separating the corners of two (2) tiles straight surface of a third tile.

Although the tile spacer 10 shows in FIGS. 1–4 have four legs 16*a*–16*d*, the tile spacer may have two or three legs to form a straight (FIG. 5) or T-shape spacer (FIG. 6).

Figure 7:
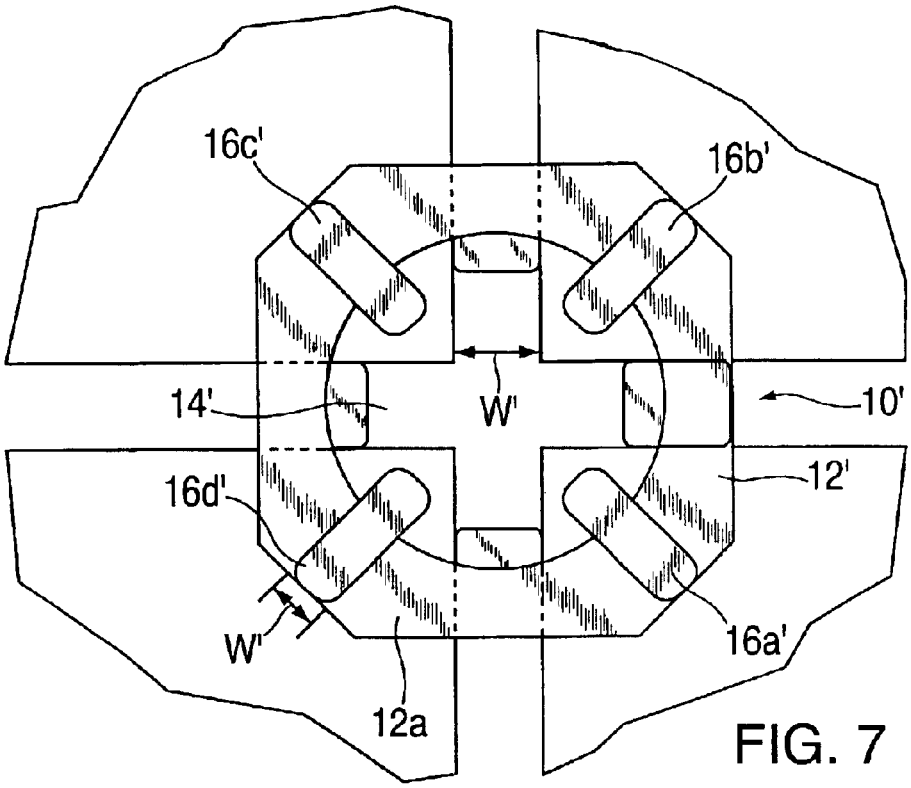
FIG. 7 is a top plan view of another embodiment of the tile spacer of the present invention.
Figure 8:
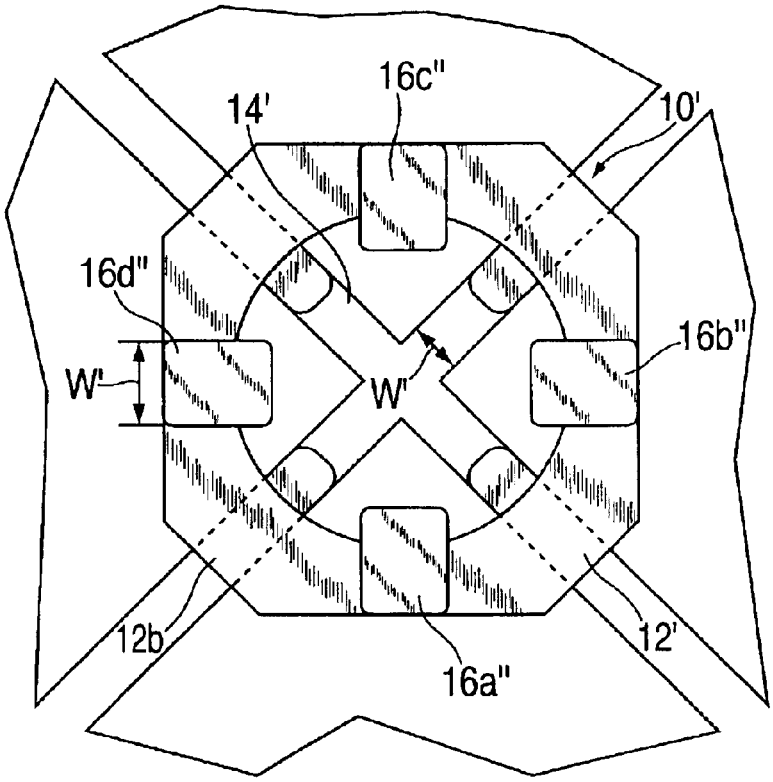
FIG. 8 is a bottom plan view of FIG. 7.

FIGS. 7 and 8 show another embodiment of the tile spacer 10' of the present invention similar to the tile spacer 10 shown in FIG. 1, except that two set of legs 16*a*'–16*d*' and 16*a*"–16*d*" extend from opposite surfaces 12*a* and 12*b* of the planar body 12'. Each leg 16*a*'–16*d*' from the first set has a width of w' and each leg 16*a*"–16*d*" from the second set has a width of W' for different tile spacing widths. Each set of legs are aligned with each other to form a cross. The two set of legs protrude slightly into opening 14' and are offset from each other to facilitate viewing of the intersecting corners of tiles through opening 14' (not shown) for proper alignment and spacing width. Similar to the tile spacers shown in FIGS. 5–6, each set of legs many include only two (2) or three (3) legs.

In view of the simple structure of the tile spacer 10 and 10' of the present invention, the tile spacer 10 can be easily manufactured or molded from plastic at a low cost. The tile spacer 10 may be made from other material such as wood, metal, rubber, etc.

The features of the invention illustrated and described herein is the preferred embodiment. Therefore, it is understood that the appended claims are intended to cover unforeseeable embodiments with insubstantial differences that are within the spirit of the claims.

What we claim is:

1. A combination of at least two tiles and a device for mounting said tiles adapted to be fixed by a layer of material to a substrate, comprising:

at least first and second tiles, each of said tiles having at least one corner and a predetermined thickness, said one corner of said first tile being spaced at a predetermined distance from said one corner of said second tile;

a planar body with upper and lower surfaces having a generally centered opening free of obstruction to allow direct, perpendicular, and unimpeded visual access of said one corner of each of said first and second tiles and its corresponding tiles to ensure proper alignment and spacing; and at least two legs extending generally perpendicular from said body from each of said upper and lower surfaces, said legs from said upper surface having a first predetermined width to form a first space consisting of a first predetermined distance and said legs from said lower surface having a second predetermined width to form a second space consisting of a second predetermined distance, wherein said upper or lower surfaces may be pressed against said corresponding tiles for proper leveling and spacing of said tiles on the substrate.

2. The combination of claim 1, wherein said body having outer edges, said legs extending from said outer edges of said body.

3. The combination of claim 1 comprising two legs from each of said upper and lower surfaces, said legs from said upper and lower surfaces are aligned to form a straight spacer.

4. The combination of claim 1 comprising three legs from each of said upper and lower surfaces, said legs from said upper end lower surfaces are aligned to form a T-shape spacer.

5. The combination of claim 1, comprising four legs from each of said upper and lower surfaces, said legs from said upper and lower surfaces are aligned to form a cross-shape spacer.

6. The combination of claim 1, wherein said first predetermined width being ⅛ of an inch and said second predetermined width being ⅜ of an inch.

7. The combination of claim 1, wherein said legs are integral with said body and formed in one piece.

8. The combination of claim 1, wherein said body and legs are made of plastic.

9. The combination of claim 1, wherein said body and legs are made of rubber.

10. The combination of claim 1, wherein said body and legs are fabricated by molding.

11. The combination of claim 1, wherein each of said legs extending from said body at a distance less than said predetermined thickness of said tiles.

12. A combination of at least two tiles and a device for mounting said tiles adapted to be fixed by a layer of material to a substrate, comprising:

at least first and second tiles, each of said tiles having at least one corner and a predetermined thickness, said one corner of said first tile being spaced at a predetermined distance from said one corner of said second tile;

a planar body with upper and lower surfaces having a generally centered opening free of obstruction to allow direct, perpendicular and unimpeded visual access of said one corner of each of said first and second tiles and its corresponding tiles to ensure proper alignment and spacing; and a first set of at least two legs extending generally perpendicular from said upper surface of said body, each of said legs of said first set having a first predetermined width to form a first space consisting of a first predetermined distance;

a second set of at least two legs extending generally perpendicular from said lower surface of said body, each of said legs of said second set having a second predetermined width to form a second space consisting of second predetermined distance; and said first set of legs are offset from said second set of legs, wherein said upper or lower surfaces may be pressed against said corresponding tiles for proper leveling and spacing of said tiles on the substrate.

13. The combination of claim 12, wherein each of said legs from said first and second sets protrudes into said centered opening.

14. The combination of claim 12, wherein each of said first and second sets of legs comprising two legs, each set of said legs are aligned to form a straight spacer.

15. The combination of claim 12, wherein each of said first and second sets of legs comprising three legs, each set of said legs are aligned to form a T-shape spacer.

16. The combination of claim 12, wherein each of said first and second sets of legs comprising four legs, each set of said legs are aligned to form a cross-shape spacer.

17. The combination of claim 12, wherein said first predetermined width being ⅛ of an inch and said second predetermined width being ⅜ of an inch.

18. The combination of claim 12, wherein each leg of said first and second set are integral with said body and formed in one piece.

19. The combination of claim 12, wherein said body and legs are made of plastic.

20. The combination of claim 12, wherein said body and legs are made of rubber.

21. The combination of claim 12, wherein said body and legs are fabricated by molding.

22. The combination of claim 12, wherein each of said legs of said first and second sets extending from said upper and lower surfaces, respectively, at a distance less than said predetermined thickness of said tiles.

23. A device for mounting at least two tiles fixed by a layer of material to a substrate, each of said tiles having at least one corner and a predetermined thickness, said one corner of said first tile being spaced at a predetermined distance from said one corner of said second tile, comprising:

a planar body with upper and lower surfaces;

a generally centered opening in said planar body free of obstruction to allow direct, perpendicular, and unimpeded visual access of said one corner of each of said first and second tiles and its corresponding tiles to ensure proper alignment and spacing;

means for pressing the tiles to ensure proper leveling and spacing;

at least two legs extending generally perpendicular from said body from each of said upper and lower surfaces, said legs from said upper surface having a first predetermined width adapted to form a first space consisting of a first predetermined distance and said legs from said lower surface having a second predetermined width adapted to form a second space consisting of a second predetermined distance.

24. A device for mounting at least two tiles fixed by a layer of material to a substrate each of said tiles having at least one corner and a predetermined thickness, said one corner of said first tile being spaced at a predetermined distance from said one corner of said second tile, comprising:

a planar body with upper and lower surfaces;

a generally centered opening in said planar body free of obstruction to allow direct, perpendicular, and unimpeded visual access of said one corner of each of said first and second tiles and its corresponding tiles to ensure proper alignment and spacing;

means for pressing the tiles to ensure proper leveling and spacing;

a first set of at least two legs extending generally perpendicular from said upper surface of said body, each of said legs of said first set having a first predetermined width adapted to form a first space consisting of a first predetermined distance;

a second set of at least two legs extending generally perpendicular from said lower surface of said body, each of said legs of said second set having a second predetermined width adapted to form a second space consisting of a second predetermined distance; and said first set of legs offset from said second set of legs.

* * * * *